United States Patent [19]

Roberto et al.

[11] 4,000,024

[45] Dec. 28, 1976

[54] BURNING RATE MODIFIERS FOR SOLID PROPELLANTS

[75] Inventors: Francisco Q. Roberto, Lancaster, Calif.; Arnold M. Crelier, Colorado Springs, Colo.; Gary D. Lium, Bellevue, Wash.

[73] Assignee: The United States of America as represented by the Secretary of the Air Force, Washington, D.C.

[22] Filed: Oct. 17, 1975

[21] Appl. No.: 623,531

[52] U.S. Cl. ..... 149/19.9; 149/19.4; 149/20

[51] Int. Cl.[2] ..... C06B 45/10

[58] Field of Search ..... 149/19.4, 19.9, 20, 149/19.3

[56] References Cited

UNITED STATES PATENTS

| | | | |
|---|---|---|---|
| 3,476,622 | 11/1969 | Harada et al. | 149/19.9 X |
| 3,752,703 | 8/1973 | Toy et al. | 149/19.4 X |
| 3,753,811 | 8/1973 | Julian et al. | 149/20 X |
| 3,801,385 | 4/1974 | Mastrolia et al. | 149/19.9 |
| 3,876,477 | 4/1975 | Eldridge et al. | 149/19.3 |
| 3,932,240 | 1/1976 | Braun et al. | 149/19.9 X |

*Primary Examiner*—Edward A. Miller

*Attorney, Agent, or Firm*—Joseph E. Rusz; William J. O'Brien

[57] ABSTRACT

A solid propellant formulation which utilizes the addition of low levels of transition metal fluorides, such as cupric fluoride and ferric fluoride, as a modifying agent to increase the propellant burning rate while simultaneously decreasing its pressure exponent.

3 Claims, No Drawings

BURNING RATE MODIFIERS FOR SOLID PROPELLANTS

STATEMENT OF GOVERNMENT INTEREST

The invention described herein may be manufactured and used by or for the Government for governmental purposes without the payment of any royalty thereon.

BACKGROUND OF THE INVENTION

This invention relates to propellant systems and to burning rate modifiers for use therewith. In a more particular aspect, this invention concerns itself with solid rocket propellant compositions and to the use of transition metal fluorides as burning rate modifiers therefor.

A considerable increase in the utilization of propellant compositions has evolved with the present interest in the operation of rockets and guided missiles. As is well known, the primary object in using a propellant is to impart motion to an object through the mechanism of a combustion reaction which transforms the propellant into a gaseous form. The mechanism by which this is accomplished differs for the various classes and types of propellants. In liquid propellants, flow rates, vaporization rates, droplet size and formation are the important factors in the combustion reaction. For the solid propellant, the propellant composition, grain size, grain surface conditions and the mechanical structure of the propellant grain are of primary importance.

In the combination of solid propellants, a significant characteristic is that the propellant grains burn in parallel layers. That is, the burning takes place in a direction perpendicular to the surface at all times. The rate at which the burning takes place is called the burning rate, and has the dimensions of velocity. In solid propellants, the burning rate is one of the most important factors to be considered and the design of any device which utilizes solid propellants is dependent upon a knowledge of this factor.

The burning rate of solid propellants is influenced by a number of factors including the pressure of the gas in contact with the burning surface. The rate increases with pressure which sometimes creates a problem in those areas, such as the nozzleless, motors that require a rather constant burning rate with changing chamber pressure. In those situations, it would be most desirable if one could produce a desirable higher burning together with a reduced pressure exponent. In attempting to overcome this problem, it was discovered that the use of transition metal fluorides as a burning rate modifier increased the burning rate of solid propellant formulations with a significant decrease in the pressure exponent. Heretofore, attempts at increasing the burning rate also increased the pressure exponent which severely limited the applicability of the propellant and the modifiers used to alter its burning rate.

SUMMARY OF THE INVENTION

In accordance with the present invention, it has been found that the burning rate of solid propellant materials can be increased while simultaneously decreasing the pressure exponent through the use of transition metal fluorides. Burning rate modifiers, such as cupric fluoride and ferric fluoride produce a significant increase in the burning rate when added to a propellant mix in amounts of about two percent by weight. The concurrent decrease in the pressure exponent makes the modified propellants especially valuable for use in nozzleless rocket motors. In such a situation, the pressure in the chamber is always decreasing and the thrust will be greatest with the propellant whose pressure exponent is zero or near zero. In this invention pressure exponents of 0.26 and 0.28 respectively were obtained by using cupric fluoride and ferric fluoride as a burning rate modifier.

Accordingly, the primary object of this invention is to provide a means for increasing the burning rate of a solid propellant material while simultaneously decreasing its present exponent.

Another object of this invention is to provide a method which employs transition metal fluorides as burning rate modifiers for solid propellants.

Still another object of this invention is to formulate a solid propellant composition that is especially useful in nozzleless rocket motors.

The above and still other objects, and advantages of this invention will become more readily apparent upon consideration of the following detailed description thereof.

DESCRIPTION OF THE PREFERRED EMBODIMENTS

Pursuant to the above defined objects, the present invention involves the utilization of transition metal fluorides as burning rate modifier for solid propellant compositions. As is well known, all propellants undergo a combustion reaction which converts the propellant ingredients into the necessary gaseous product needed to impart motion to rockets and guided missiles. The mechanism of the combustion reaction differs for the various types of propellants. For solid propellants, combustion takes place in parallel layers and proceeds in a direction perpendicular to the surface. The rate at which the combustion takes place is referred to as the "burning rate" and is one of the most important parameters employed in ascertaining the efficiency of the propellant. The burning rate has the dimensions of velocity with higher burning rates being most desirable. However, a serious problem occurs with attempts at increasing the burning rate since such increases also result in an increase in the pressure exponent. Often times the increase attendent conventional approaches at increasing the burning rate is excessive to the point that severely limits the applicability of the particular burning rate modifiers relied upon heretofore.

With this invention however, it has been found that the burning rate of solid propellants can be increased simultaneously with a significant decrease in the pressure exponent. The unexpected improvement in burning rate results from the incorporation of low levels of transition metal fluorides into a solid propellant. The improvement is most pronounced when cupric fluoride or ferric fluoride in amounts of about two percent by weight are incorporated into solid propellants prepared with a hydrocarbon binder constant aluminum metal as the fuel component and ammonium perchlorate as the solid oxidizer component. The invention is particularly applicable to solid rocket motors where a relatively constant propellant burning rate with changing chamber pressure is required such as in the nozzleless motor.

The improvements attendent the incorporation of the fluoride modifiers of this invention are even more pronounced when the solid oxidizer, ammonium perchlorate is a trimodal mix of particle sizes ranging from fine to coarse. For example, an oxidizer have a 6/25/200 micron particle size blend provides optimum results. The invention is novel because it successfully demonstrates the use of $CuF_2$ and Fe $F_3$ for increasing the burning rate of a solid propellant together with a significant decrease in the pressure component. The problem of obtaining solid propellants with a burning rate range of from about 0.6 to 0.8 inches per second at 1000 psi with pressure exponents having an n value of less than 0.3 has been solved by this invention. Normally, the n value will be approximately 0.5 for an aluminized propellant with the above specified burning rate range.

The following tabulation in Table I discloses typical formulations of propellant compositions using transition metal fluorides as burning rate modifiers. Examples 1 and 2 show the use of cupric fluoride and ferric fluoride while Example 3 discloses a formulation without any additive for comparative purposes. The cupric and ferric fluorides are used in the anhydrous form and were sieved with a fine mesh screen (0.053 mm) prior to use. The preparation of the solid propellants with these additives follows the conventional procedure for hydrocarbon polyurethane propellants and no special safety or processing aids are required. The tabulation in Table I gives the compositional content of the propellant formulations in percent by weight together with the unexpected improvements of a reduced pressure exponent with burning rate acceleration.

TABLE I

| Formulation | Examples (% by wt.) 1 | 2 | 3 |
|---|---|---|---|
| *Hydrocarbon Binder | 12.0 | 12.0 | 12.0 |
| $NH_4ClO_4$ (Trimodal, 6/25/200μ particle size | 68.0 | 68.0 | 68.0 |
| Al, (6μ particle size) | 18.0 | 18.0 | 20.0 |
| $CuF_2$ (40μ particle size) | 2.0 | — | — |
| $FeF_3$ (40μ particle size) | — | 2.0 | — |
| Burn Rate (in./sec. at 1000 psi) | 0.670 | 0.648 | 0.520 |

TABLE I-continued

| Formulation | Examples (% by wt.) 1 | 2 | 3 |
|---|---|---|---|
| Pressure Exponent | 0.26 | 0.28 | 0.32 |

*Based on Hydroxy-Terminated Polybutadiene cured with isophorone diisocyanate.

The burn rate at 1000 psi for the formulation absent a burn rate modifier was 0.520 psi with a pressure exponent of 0.32. The formulations which utilize the burning rate modifier of this invention, however, have rate enhancements on the order of 30 percent with a greater than 10 percent reduction in pressure exponent. Generally, an increase in the pressure exponent is undesired in most instances due to the constraints it puts on motor design. This invention, however, provides a unique means for circumventing this problem while simultaneously providing propellant formulations with enhanced burning rates.

While the invention has been described with particular reference to specific embodiments thereof, it is to be understood that the present disclosure has been made by way of illustration only and that numerous changes and alterations in the details of this invention may be resorted to without departing from the spirit and scope of the appended claims.

What is claimed is:

1. In a solid propellant formulation composed of a hydroxy-terminated polybutadiene binder component, a powdered aluminum metal component, and a powdered ammonium perchlorate oxidizer component, the improvement which comprises the addition of a minor amount of a powdered transition metal fluoride selected from the group consisting of cupric and ferric fluorides as a burning rate modifier.

2. In a propellant formulation according to claim 1 wherein said improvement comprises the addition of about 2 percent by weight of cupric fluoride.

3. In a propellant formulation according to claim 1 wherein said improvement comprises the addition of about 2 percent by weight of ferric fluoride.

* * * * *